United States Patent [19]

Toelke

[11] 4,372,003

[45] Feb. 8, 1983

[54] INDUSTRIAL PIPE THREAD CLEANER

[75] Inventor: Lester W. Toelke, Houston, Tex.

[73] Assignee: International Tool & Supply Co., Inc., Houston, Tex.

[21] Appl. No.: 158,342

[22] Filed: Jun. 10, 1980

[51] Int. Cl.[3] ..... B08B 9/02

[52] U.S. Cl. ..... 15/88; 15/104.04; 15/104.05

[58] Field of Search ..... 15/21 R, 56, 71, 75, 15/88, 97 R, 104.03, 104.04, 104.05, 104.1 R, 76, 181

[56] References Cited

U.S. PATENT DOCUMENTS

| | | | |
|---|---|---|---|
| 1,279,996 | 9/1918 | Dorland | 15/181 |
| 2,032,916 | 3/1936 | Cunningham | 15/76 |
| 3,044,092 | 7/1962 | Fox et al. | 15/75 |
| 4,011,617 | 3/1977 | Toelke et al. | 15/88 |
| 4,014,062 | 3/1977 | Scott et al. | 15/88 |

FOREIGN PATENT DOCUMENTS

| | | | |
|---|---|---|---|
| 831797 | 1/1970 | Canada | 15/104.03 |

*Primary Examiner*—Edward L. Roberts
*Attorney, Agent, or Firm*—Arnold, White & Durkee

[57] ABSTRACT

A powered pipe thread cleaner for oil pipe and oil casings has a housing which defines a sump for collecting dirty solvent during the thread cleaning process. The thread cleaner is of the driven brush type and employs specially configured brushes and brush support structures for minimal interference where the flow of dirty fluid within the housing during cleaning. The thread cleaner is designed for operator comfort and ease of operation.

9 Claims, 8 Drawing Figures

84
82
10
80
24
60
22
26
28
72
76
78
70
71
74
20
68
14
106
52
24
31
90
21
98
12B
16
54
38
36
50

26
22
10
84
24
32
31
40
14
21
30
12

116
128
126

30
66
34
62
60
18
68
36
52
31
54
90
32
64
66
18
32
65
56
50
38

INDUSTRIAL PIPE THREAD CLEANER

BACKGROUND OF THE INVENTION

This invention relates generally to powered thread cleaners for industrial tubulars such as pipes and casings and more particularly relates to such thread cleaners employing brushes which scrub the threads.

Industrial pipes and casings often are connected, disconnected and reconnected during the lifetime of the pipes and casings. The connection takes the form of a pin end of a pipe being threaded into the box end of another pipe. During the lifetime of the pipes and casings, the threads of both the pin end and the box end often become corroded with foreign deposits which interface with subsequent use. For example, in the oil field pipes and casings from one installation are often subsequently reused in a later installation. And prior to the subsequent use, the threads oftentimes become contaminated with foreign deposits.

To ameliorate the task of cleaning the threads prior to subsequent usage, powered thread cleaners have been devised. One type of powered thread cleaner employs highly pressurized fluid directed against the threads to be cleaned. Another type of powered thread cleaner employs one or more stiff brushes which are scrubbed against the threads to be cleaned. This latter type also employs fluid sprayed onto the threads, but the fluid is not the primary cleaning mechanism. It serves merely to carry away the contaminants and foreign deposits loosened from the threads by the brushes.

Because of the fluid sprayed on the threads during the thread cleaning process, consideration has been given to minimizing leakage and spillage of the fluid from the thread cleaner. Output ports are provided in the housing of the thread cleaner to allow hose connections for conveying the used or spent fluid to an appropriate reservoir for filtering or other recycling of the fluid. While prior art thread cleaners have provided satisfactory solutions for conveying the spent fluid from the thread cleaner housing to the spent fluid reservoir, they have not maximized the efficiency of carrying spent fluid from the pipe threads to the exit port of the thread cleaner housing. Also, the prior art designs have not maximized the efficiency of applying the fluid to the threads of box ends or collars. Further, the prior art thread cleaner designs have not maximized the efficiency of providing new or replacement brushes with a minimum of economy, effort and time from the operator.

SUMMARY OF THE INVENTION

The above noted and other shortcomings of the prior art are overcome by the present invention by providing a powered pipe thread cleaner of a particular design. In one aspect, the powered thread cleaner is provided with a sump to collect the used cleansing fluid with minimal interference with further thread cleaning. Special brushes and brush connecting structures are employed to facilitate application of the clean fluid to the threads and to facilitate removal of the spent fluid from the threads. The novel brush connecting structures minimize operator time and effort in providing new and replacement brushes.

According to one aspect of the invention, a powered pipe thread cleaner is especially adapted for cleaning the threads of industrial tubulars such as oil well tubulars including, pipes, tubing and casings. The thread cleaner has a housing having one end for receiving the threaded member to be cleaned. Brush structure is movably supported in the housing for scrubbing the threads and removing deposits thereon. A fluid injecting mechanism is supported within the housing for injecting solvent onto the threads during cleaning to thereby wash the removed deposit away from the threads. The housing is configured to include a shaped sump defining structure in a bottom portion thereof such that the injected solvent drains into and collects in the sump after it has been injected onto the threads. An exit port is provided at the bottom of the sump to allow the collected solvent to pass from the housing. When the collected solvent is in the sump, it is sufficiently removed from the moving brush structure to minimize sloshing and recontamination of the threads by the dirty solvent.

The thread cleaner is adapted to accommodate both box ends and pin ends of tubulars. A first fluid injector is provided in the housing for cleaning pin ends and a second fluid injector is provided in the housing for alternately cleaning box ends. The box end cleaning injector is centrally located and movable with the brush structure for dispensing solvent outwardly and upwardly onto the threads during rotation of the brush structure during cleaning.

Preferably the pipe cleaner includes a specially shaped support structure for supporting and moving the brush structure. The support structure is shaped in the form of a spider or clover leaf with the brushes of the brush structure mounted on the leaves of the clover leaf. The spacing between the leaves of the clover leaf facilitates removal of the dirty fluid to the sump.

Also, each leaf of the clover leaf support structure defines a plurality of receptacles for receiving a single brush of the brush structure. The receptacles are arranged in increasing distances from the center of the support structure to accommodate the cleaning of pipes and casings of different diameters. The spacing between leaves of the clover leaf minimizes confusion of the operator of the cleaner when he must select the right receptacle for insertion of the brush for a given diameter pipe.

As an outstanding feature, the design of the support structure and brush structure is such to eliminate any need for a centering structure projecting from the support structure for guiding the pipe into place in the pipe cleaner.

According to another aspect of the invention, brushes used in the pipe cleaner are of a design to further facilitate removal of the dirty solvent to the sump and to facilitate their coupling and decoupling to the leaves of the clover leaf support member. The brush of the preferred design includes a shaped mandril having a plurality of round, flat brushes supported thereon at spaced locations along the mandril. The spaces between the brushes minimize interruption of the flow of dirty solvent to the sump and minimize the tendency of the brush to become saturated with the contaminants loosened from the threads. Also, the shaped mandril is connected to a given receptacle in the clover leaf by structure which fixes the orientation of the mandril and thus the brush with respect to the threads to be cleaned. After wear of the brush at a given orientation, the brush is rotated with respect to the support structure to provide a fresh unworn brush surface. In this manner, the life of a given brush is extended. By using quick disconnects for connecting the mandril to the support structure, rotation and changing of the brushes is simplified and easily accomplished.

According to another aspect of the invention a reversing mechanism is provided for allowing the brush support structure to be rotated alternately in opposite directions. This facilitates usage of the thread cleaner on especially large diameter tubulars. Brush rotation in one direction screws the cleaner onto the tubular at the beginning of cleaning and brush rotation in the opposite direction unscrews the cleaner off the tubular at the end of the cleaning.

It is accordingly a general object of the subject invention to provide a new and improved industrial thread cleaner which is especially adapted for operator convenience.

BRIEF DESCRIPTION OF THE DRAWINGS

The above noted features and advantages of the invention will become more apparent upon reading of a description of a preferred embodiment of the invention wherein.

DETAILED DESCRIPTION OF A PREFERRED EMBODIMENT

Figure 2:
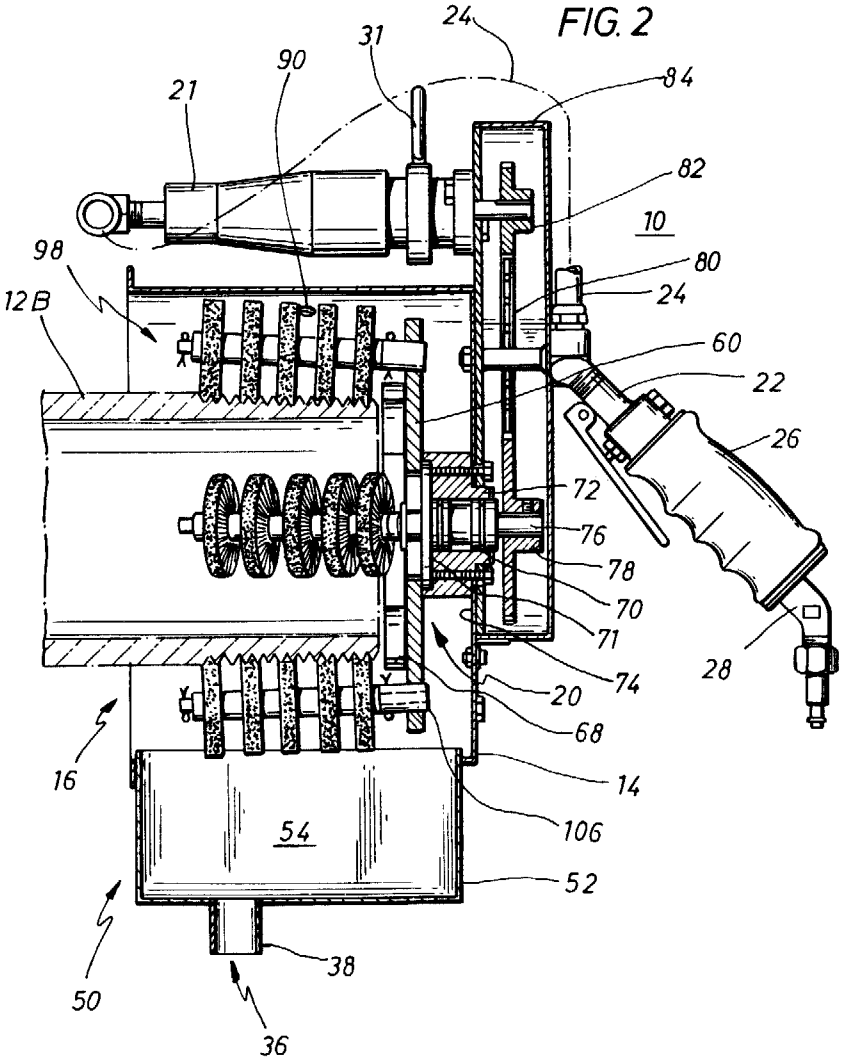
FIG. 2 is a cross-sectional view of the thread cleaner of FIG. 1B, showing structure for cleaning a pin end.
Figure 1A:
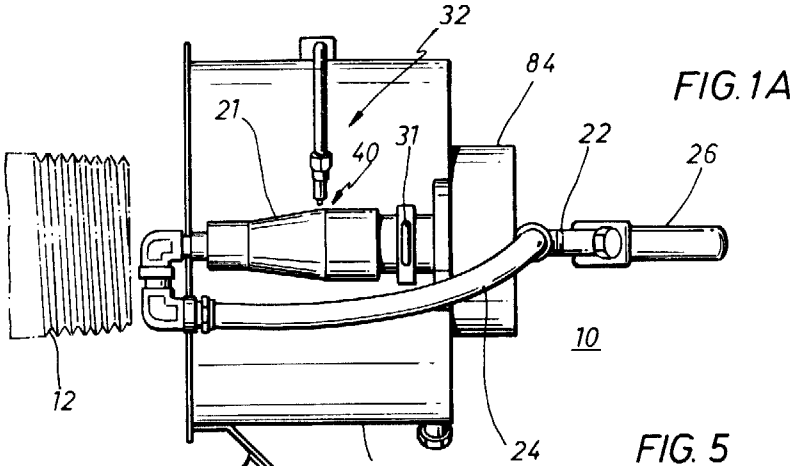
FIGS. 1A and 1B are top and end views of one embodiment of the thread cleaner of the present invention.

Referring to FIGS. 1A, 1B, 2 and 3A,BB, a powered thread cleaner 10 constructed and arranged according to the invention is shown for cleaning industrial tubulars 12 such as oil well pipes, casings, and tubes. A collar or box end 12A to be cleaned is shown in FIG. 3B and a pin end 12B to be cleaned is shown in FIG. 2.

The thread cleaner 10 includes a housing 14 which encloses a cleaning mechanism 16 which preferably takes the form of one or more brushes 18. The brushes preferably are configured at an angle according to the taper of the threads. A drive mechanism 20 is supported on the housing 14 for rotating the cleaning mechanism 16. The drive mechanism preferably takes the form of an air motor 21. A speed control 22 is supported on the housing 14 and is coupled to the air motor 21 by a hose 24 for controlling the speed of the air motor 21. A handle 26 is provided adjacent the speed control 22 to allow the operator to position the thread cleaner 10 while controlling operation of the drive mechanism 20. A connector 28 is mounted to the handle 26 for providing pressurized air to the thread cleaner 10. A second handle 30 is provided at a spaced location on the housing 14 for facilitating positioning of the cleaner 10.

After the housing 14 has been placed on the pipe 12 to be cleaned, operation of the speed control 22 effects rotation of the brushes 18 for scrubbing and thereby cleaning the threads. To facilitate positioning of the thread cleaner 10 on the pipe 12, an eye hook 31 is mounted to the housing 14 to optionally allow a vertical support mechanism (not shown) to be attached to the thread cleaner 10.

A pair of fluid input ports 32, 34 is provided on the housing 14 for supplying suitable cleansing fluid or solvent to the thread cleaner 10. The cleansing fluid is directed onto the threads during cleaning for removing deposits which have been loosened by the brushes 18. The fluid collects the loosened deposits and passes from the thread cleaner 10 via an exit port 36 on the housing 14, discharging the deposits and contaminants from the housing 14. A connector 38 allows a hose (not shown) to be connected to the exit port 36 for conveying the dirty fluid to a receiving tank (not shown) where the fluid may be recycled or otherwise deposed of.

As an outstanding feature of the present invention, the housing 14 includes structure which defines a sump 50. The sump 50 takes the form of a metal sheet 52 which is shaped to define a reservoir 54 and which is connected to a bottom portion of the housing 14. The sheet 52 is placed over an opening 56 in the housing 14 to allow dirty or spent fluid to drain from the upper housing 14 into the sump to remove it sufficiently from the thread cleaning operation to prevent it from sloshing and otherwise interfering with subsequent thread cleaning the opening 56 is substantially larger than the exit port 36. In particular, because the dirty or spent fluid contains removed contaminants and deposits, sloshing of the dirty fluid against the brushes 18 and the threads tends to reapply the contaminants to the threads being cleaned. The exit port 36 is in the bottom of the sheet 52 at the bottom of the reservoir 54, and the connector 38 is welded to the sheet 52.

Figure 1B:
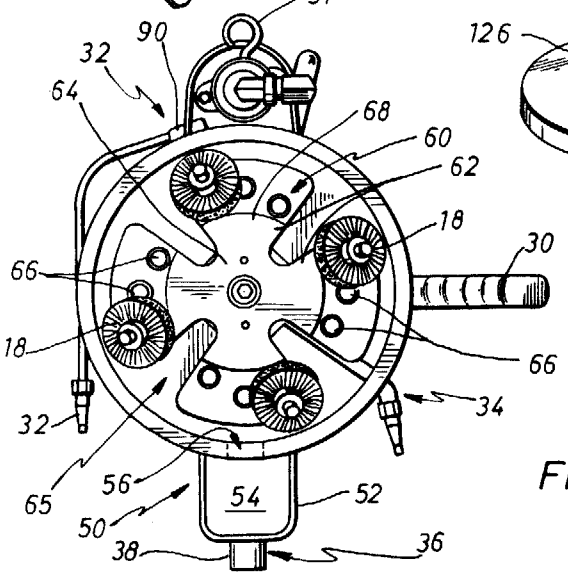

In the preferred and illustrated embodiment, the housing 14 is configured in the shape of a cylinder, with the pipe 12 to be cleaned inserted into the housing along an axis of the cylinder. As seen in FIG. 2, the sheet 52 and the opening 56 extend substantially the entire length of the housing 14 parallel to the housing axis to facilitate expedient removal of the dirty fluid into the sump 50. As seen in FIG. 1B, the sheet 52 extends around a suitable arc of the perimeter of the housing 14 to facilitate collection of the dirty fluid.

As a feature of the invention the cleaning mechanism 16 includes a brush support structure 60 having an irregularly shaped periphery. As seen in FIG. 1B, the brush support structure 60 is shaped in the form of a spider or clover leaf. A plurality of portions or leaves 62 extend from a central portion 64. Preferably, a single brush 18 is mounted on a respective leaf 62. The spacing 65 between the leaves 62 facilitates removal of the dirty cleaning fluid to the sump 50. Because of the design of the structure 60 and brushes 18, a centering guide projecting from the structure 60 for guiding the pipe 12 into place has been eliminated.

As seen in FIG. 1B, each of the leaves 62 defines a plurality of slots 66. The slots 66 progressively increase in distance from the central portion 64 in order to accommodate the cleaning of pipe 12 of different diameters. As shown in FIG. 1B, all of the brushes 18 are in the set of slots 66 furthest from the central portion 64 to accommodate the largest diameter pipe 12 for the depicted housing 14. The spacing 65 between the leaves 62 also provides the advantage of a visual reference with respect to the slots 66 so that the operator can most easily and reliably insert the brush 18 into the proper slot 66 for accommodating the proper diameter of pipe 12.

A bumper pad 68 is supported on the central portion 64. The pad 68 protects pin ends from damage when otherwise being rammed into the portion 64.

Figures 3A, 3B, 4, 6:
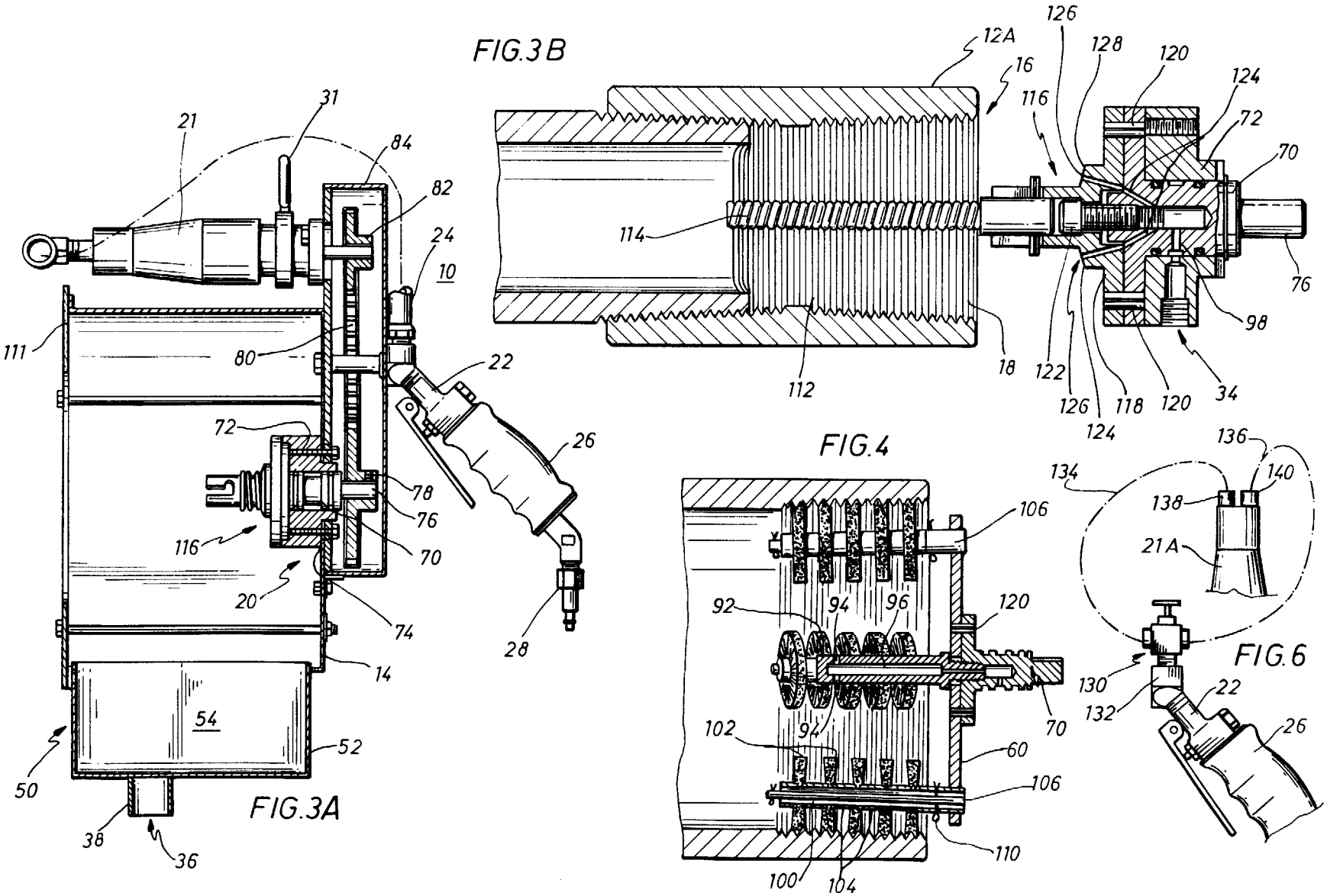
FIGS. 3A and 3B are partial cross-sectional views of the thread cleaner adapted for cleaning small diameter collars and box ends.
FIG. 4 is a partial cross-sectional view of brush structure especially adapted for cleaning large diameter collars and box ends.
FIG. 6 is a partial schematic of a reversing mechanism for controlling the direction of rotation of the brush structure.

Referring to FIGS. 2 and 3A, 3B the drive mechanism 20 effects rotation of the brush support structure 60 and thus of the brushes 18. In addition to the air motor 21 the drive mechanism 20 includes a flanged drive shaft 70, having a flange 71, which is journaled into and extends through a bearing housing 72. The bearing housing 72 is mounted to a surface 74 of the housing 14, and the drive shaft 70 has a portion 76 extending beyond the surface 74 for carrying a sprocket 78. The sprocket 78 is connected by a chain 80 to a sprocket 82 of the air motor 21. A chain guard cover 84 encloses the chain 80 and sprockets 78, 82.

The described clover leaf shaped brush support structure 60 may be used for cleaning the threads of a pin end such as shown in FIGS. 1B and 2 or for cleaning the threads of a collar or box end as shown in FIGS. 3A and 4. However, the mechanism for providing the cleansing fluid to the threads differ.

In the pin cleaning embodiment of FIG. 2, the input port 32 is connected to a nozzle 90 in the upper part of the housing 14. The nozzle 90 is directed to spray the cleansing fluid onto the upper part of the threads being cleaned so that the fluid washes the entire circumference of the pin end and then drains into the sump 50.

In the FIG. 4 embodiment for collars and box ends, an elongated nozzle 92 supported on the drive shaft 70. The nozzle 92 has output apertures 94 connected to a central passageway 96 which are in fluid communication with a passageway 98 (FIG. 3B) in the drive shaft 70. The passageway 98 is in fluid communication with the input port 34.

The brush 18 utilized in the embodiment of FIGS. 1B, 2 and 4 is of a special design as a feature of the invention. The brush 18 is comprised of an elongated mandril 100 (FIG. 4) having thereon a plurality of "rivet" brushes 102 separated by a set of spacers 104. The rivet brushes 102 are round, relative thin sections of brushes which extend completely around the mandril 100. Such brushes are commercially available from Special Brush Company, Hudson, Ohio under the designation "rivet" brush.

As an outstanding feature of the invention the brushes 102 are adjustably fixed in orientation with respect to the support structure 60 and thus with respect to the pipe 12 being cleaned. For a given orientation of the brush 102, only a relatively small area thereof engages the threads being cleaned. When this area becomes worn or otherwise ineffective for cleaning, the orientation of the brush is changed with respect to the support structure 60.

To accomplish the adjustably fixed orientation of the brushes 102 with respect to the support structure, the mandril 100 is of a shaped cross-section, and the rivet brushes 102 are mounted on the mandril 100 accordingly in a fixed orientation. In the preferred and illustrated embodiment the mandril 100 is square (FIG. 1B) and the center of the brushes 102 is square to fit onto the mandril 100. One end of the mandril 100 accommodates a cotter key for maintaining the brushes 102 and the spacers 104 in relatively fixed positions on the mandril 100. The other end of the mandril 100 is adapted to fit into a receptacle 106 on the brush support structure 60.

In the preferred and illustrated embodiment, the receptacle 106 includes a section of tubing mounted in the structure 60 and extending upwardly for receiving the mandril 100. The tubing is of a sufficient diameter to receive the mandril 100 and defines a hole for receiving a cotter key 110 which extends through an aperture (not shown) in the mandril 100, fixing the orientation of the mandril with respect to the support structure 60. Thus, when a portion of the brush 102 becomes worn, the mandril 100 may simply be rotated by removal of the key 110, rotating the mandril, and replacing the key 110.

It will be understood that if desired the receptacle 106 could be shaped in the same cross-sectional configuration as the mandril 100, and that other than square mandrils could be employed.

Referring now to FIGS. 3A and 3B, yet another embodiment of the thread cleaner 10 is shown. This embodiment is especially adapted for cleaning relatively small diameter collars and box ends. A splash shield 111 may suitably be employed to minimize splashing and fluid loss when cleaning pin ends. For this application the brush 18 of the cleaning mechanism 16 consists of a single brush 112 of a diameter on the order of the diameter of the collar being cleaned. The brush 112 is commonly referred to as a "flue" brush or a "pipeline" brush which is constructed in a solid cylindrical configuration.

Figure 5:
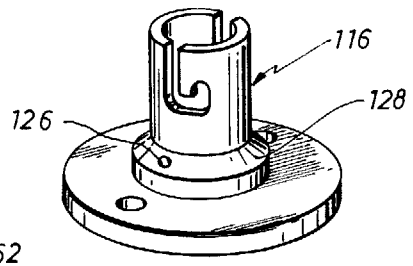
FIG. 5 is a schematic drawing of a collar used by the thread cleaner when cleaning pin ends.

The flue brush 112 has a stem 114 which is configured to connect to the drive shaft 70 via a bayonet joint 116. The bayonet joint is implemented via a collar 118 attached to the flange 71 via a pair of drive pins 120 and a bolt 122. The collar 118 is shown in more detail in FIG. 5. Although not shown in FIG. 3 it is understood that the stem 114 is configured to fit into the collar 118 in a conventional bayonet joint fashion.

As a feature of this aspect of the invention, the collar 118 and the flanged drive shaft 70 define a pair of passageways 124 which are in fluid communication with the input port 34 via the passageway 98. The passageway 124 defines a pair of openings 126 in a surface 128 of the collar 118. The surface 128 is inclined upwardly as shown in FIG. 3B to spray the cleansing fluid on the threads being cleaned. This upward and outward spraying of the cleansing fluid is believed to provide improved wetting and removal of the deposits from the threads during cleaning.

As yet another feature of the invention, and referring to FIG. 6, a reversing mechanism 130 is coupled between the speed control 22 and the motor 21 for allowing the brush support structure 60 alternately to be rotated in different directions. As shown the reversing mechanism 130 preferably takes the form of a diameter valve 132 having a pair of lines 134, 136 connected to input ports 138, 140 of a reversible air motor 21A. The valve 132 is actuated to provide air pressure to the motor 21A via one of the lines 134, 136, and the direction which the motor rotates is determined by which of the lines 134, 136 is pressurized.

This feature is particularly useful when cleaning the threads of large diameter tubulars, such as twenty inch oil casing. By actuating the valve 132 to rotate the brushes 18 in one direction, the cleaner 10 is screwed onto the tubular until the pad 68 engages the end of the tubular to commence cleaning. Reversing the valve 132 reverses the direction of rotation of the brush 18 to back the cleaner off the tubular when cleaning is finished. Considering the size and weight of the cleaner 10 necessary to clean twenty inch casing, this feature considerably minimizes operator strain.

It will thus be appreciated that a new and improved pipe thread cleaner has been described. The improved pipe thread cleaner is designed for simple and quick maintenance and repair as well as enhancing environmental safety. For example, complete disassembly and reassembly of the unit requires approximately 30 minutes. Changing of the rivet brushes 102 requires approximately 10 minutes and changing of the flue brush 112 requires less than a minute.

Although the invention has been described in its preferred form with a certain degree of particularity, it is understood that the present disclosure has been made only by way of example. Numerous changes in the details and construction of the combination and arrangement of parts will be apparent without departing from the spirit and the scope of the invention.

What is claimed is:

1. A powered thread cleaner especially adapted for cleaning threads of industrial tubulars, comprising:

(a) a housing having an end for receiving the threaded member to be cleaned;

(b) a brush support structure rotatably supported and driven within said housing;

(c) a set of brushes supported around the periphery of said brush support structure, said brush support structure having an irregularly shaped perimeter defining a plurality of perimeter portions extending from a central portion, said perimeter portions having means for adjustably securing a respective brush in a selected orientation with respect to the threads to be cleaned, and (d) and set of brushes including one or more brush assemblies having (i) a shaped mandril upstanding from the brush support member and (ii) a plurality of relatively thin circular brushes spaced from one another on said mandril and mounted on said mandril in an adjustably fixed orientation with respect thereto.

2. The thread cleaner according to claim 1, wherein each said perimeter portion includes a plurality of receptacles for receiving the mandril.

3. The thread cleaner according to claim 2 and including means for injecting a cleaning solvent onto the threads during cleaning, and wherein said housing further includes sump defining structure at the bottom part of said housing for receiving said solvent after it has washed the threads being cleaned.

4. The thread cleaner according to claim 3 and including a connector at the bottom of said sump defining structure for receiving a line for passing the solvent away from the housing.

5. The thread cleaner according to claim 3, wherein said sump defining structure extends substantially along the entire bottom portion of said housing.

6. The thread cleaner according to claim 1 and including:

(a) a reversible motor for alternately moving said brush support structure in opposite rotational directions; and (b) a reversing mechanism coupled to said motor for controlling said rotational direction of the brush support structure.

7. A powered thread cleaner especially adapted for cleaning threads of industrial tubulars, comprising:

(a) a housing having an end for receiving the threaded tubular to be cleaned;

(b) a brush structure movably supported in said housing for scrubbing the threads and removing deposits thereon;

(c) a rotatable support member for supporting and moving said brush structure against the threads to be cleaned, said brush structure comprising one or more brushes which include:

(i) a shaped mandril having a cross-sectional configuration defined by a number of equilateral sides, said support member defining a receptable for receiving said mandril;

(ii) one or more circular, relatively thin brushes supported on said mandril; and (iii) structure for removably securing the mandril to the receptacle in a selected orientation, whereby the orientation of said brush with respect to the support member may be changed from time to time to allow different portions of said brushes to engage the threads to be cleaned.

8. A powered thread cleaner especially adapted for cleaning threads of industrial tubulars, comprising:

(a) a housing having an end for receiving the threaded tubular to be cleaned;

(b) a brush structure movably supported in said housing for scrubbing the threads and removing deposits thereon;

(c) a fluid injecting mechanism supported within said housing for injecting fluid onto the threads during cleaning to thereby wash the removed deposit away from the threads;

(d) said housing including a shaped sump defining structure in a bottom portion thereof, and said housing being shaped to allow the injected fluid to drain into and collect in the sump after it has been injected onto the threads;

(e) said housing further defining an exit port in the bottom of said sump to allow the collector fluid to pass from the housing, whereby when the collected fluid is in the sump, it is sufficiently removed from the moving brush structure to minimize sloshing and recontamination of the threads;

(f) a rotatable support member for supporting and moving said brush structure against the threads to be cleaned, said brush structure comprising one or more brushes which include:

(i) a shaped mandril having a cross-sectional configuration defined by a number of equilateral sides, said support member defining a receptacle for receiving said mandril;

(ii) one or more circular, relatively thin brushes supported on said mandril; and (iii) structure for removably securing the mandril to the receptacle in a selected orientation, whereby the orientation of said brush with respect to the support member may be changed from time to time to allow different portions of said brushes to engage the threads to be cleaned.

9. A powered thread cleaner especially adapted for cleaning threads of industrial tubulars, comprising:

(a) a housing having an end for receiving the threaded tubular to be cleaned;

(b) a configured brush structure movably supported in said housing for engaging and scrubbing the threads and removing deposits thereon;

(c) a fluid injecting mechanism supported within said housing for injecting fluid onto the threads during cleaning to thereby wash the removed deposit away from the threads;

(d) said housing including a shaped sump defining structure in a bottom portion thereof, and said housing being shaped to allow the injected fluid to drain into and collect in the sump after it has been injected onto the threads;

(e) said housing further defining an exit port in the bottom of said sump to allow the collected fluid to pass from the housing, whereby when the collected fluid is in the sump, it is sufficiently removed from the moving brush structure to minimize sloshing and recontamination of the threads;

(f) a reversible motor for alternately moving said brush structure in opposite rotational directions; and (g) a reversing mechanism coupled to said motor for controlling said rotational direction of the brush structure, whereby rotation in one direction with the brush structure in engagement with the brushes effects screwing of the thread cleaner onto the tubular, and whereby rotation in the opposite direction effects unscrewing of the brush structure off the tubular.

* * * * *